US005449221A

United States Patent [19]

Stander

[11] Patent Number: 5,449,221

[45] Date of Patent: Sep. 12, 1995

[54] PORTABLE LEG REST

[76] Inventor: Maxwell Stander, 11512 Taber St., Silver Spring, Md. 20902

[21] Appl. No.: 206,927

[22] Filed: Mar. 7, 1994

[51] Int. Cl.[6] ..... A47C 7/52

[52] U.S. Cl. ..... 297/423.4; 297/DIG. 6; 297/423.1

[58] Field of Search ..... 297/423.1, 423.39, 423.4, 297/423.41, 423.44, 423.46, DIG. 6, 423.38, 423.42, 423.43, 423.45, 423.19

[56] References Cited

U.S. PATENT DOCUMENTS

| | | | |
|---|---|---|---|
| 787,676 | 4/1905 | Kelly | 297/423.41 |
| 938,172 | 10/1909 | Schulz | 297/423.4 X |
| 2,248,369 | 7/1941 | Ludersen | 297/423.45 X |
| 2,614,613 | 10/1952 | Bushong | 297/423.39 |
| 3,161,435 | 12/1964 | Halverson | 297/423.39 |
| 3,264,033 | 8/1966 | Hansburg | 297/423.39 |
| 3,520,572 | 7/1970 | Flaugh | 297/423.45 |
| 3,580,633 | 5/1971 | Du Priest | 297/423.40 X |
| 4,345,793 | 8/1982 | Duda | 297/423.40 |
| 5,154,484 | 10/1992 | Aronson | 297/423.39 |

FOREIGN PATENT DOCUMENTS

| | | | |
|---|---|---|---|
| 0667114 | 7/1963 | Canada | 297/423.45 |
| 2503665 | 8/1976 | Germany | 297/438 |
| 0012611 | 9/1915 | United Kingdom | 297/423.41 |
| 0608086 | 9/1948 | United Kingdom | 297/423.41 |

*Primary Examiner*—Kenneth J. Dorner
*Assistant Examiner*—Milton Nelson, Jr.

[57] ABSTRACT

A portable leg rest having a thin, rectangular platform with a leg-supporting upper surface and hinges that pivotally connect to a seating portion that is placed on a chair, bench or sofa. The leg rest is extended and supported by folding legs that pivot from the underside of the leg rest and position on the floor or ground. This provides an elevated leg rest in which the height and angle is adjusted by manually varying the length of the supporting legs.

The hinges permit the leg rest to swing from the near horizontal position downward to the folded, transport position lying flat against the lower surface of the seating portion. Stops on the leg rest support leg pivots limit the distance it can move forward of the leg rest.

The assembly can be quickly and conveniently lifted from the seating surface, folded essentially flat, and held temporarily closed for storage or carried to another seating surface. The assembly is opened up quickly by disengaging the hook and loop fastenings, unsnapping the leg rest support from the clip, opening the seat, placing it upon the chair, bench or sofa and placing the support on the floor or ground.

4 Claims, 2 Drawing Sheets

PORTABLE LEG REST

BACKGROUND OF THE INVENTION

This invention pertains to a portable, compact folding leg rest assembly that can be used on a seating surface without any mechanical attachments thereto.

In prior art, leg rests designed to provide support for persons with leg injuries, back pain, muscular afflictions, or fatigue requiring leg elevation have been attached to a chair by fastenings, siderails or mechanical linkages. Although the reclining chair described in U.S. Pat. No. 4,621,863 provides for a leg rest that is detachable and pops off under some force, the linkages are complex and it is difficult to reassemble the leg rest and the chair. In the preferred embodiment of this invention, the assembly uses simple construction, is not mechanically attached at any time to a seating surface and can be quickly and conveniently used, transported or stowed.

SUMMARY OF THE INVENTION

In the preferred embodiment of the invention, the assembly includes a portable leg rest pivotally attached to the seating portion by a simple hinge, the leg rest elevated and supported by folding adjustable legs. Placing the seating portion flatwise on a stationary seating surface, extending the leg rest, opening up the folding support, adjusting its length and placing it on the floor or ground enables the person to benefit from leg elevation on a chair, bench or sofa. When not in use, the assembly is quickly and easily lifted from the seating surface, folded flat, and held temporarily closed in this position for ready transport or storage. No tools or special equipment are required for either operation. The leg rest assembly is simple to operate, light in weight, compact when folded and inexpensive to manufacture.

BRIEF DESCRIPTION OF DRAWINGS

For a fuller understanding of the invention, reference is made to the following description and accompanying drawings, in which.

DETAILED DESCRIPTION

Figure 1:
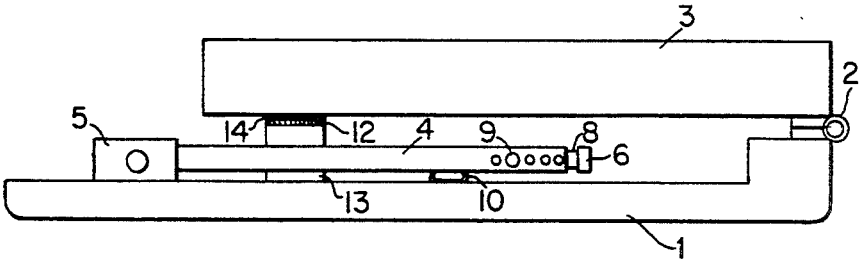
FIG. 1 is a side view of the assembly fully closed for transport or storage.
Figure 2:
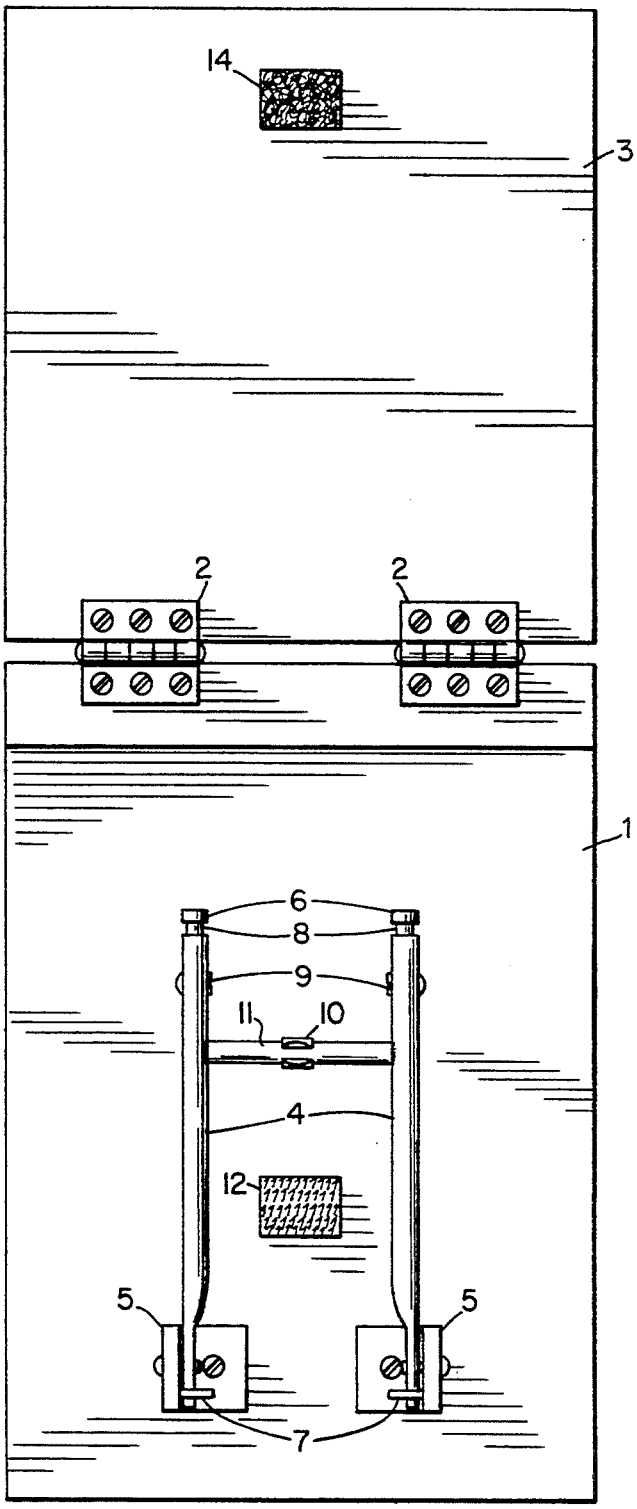
FIG. 2 is a bottom view showing the seating portion and leg rest folded open with the leg rest supporting legs held flat on the underside of the leg rest.
Figure 3:
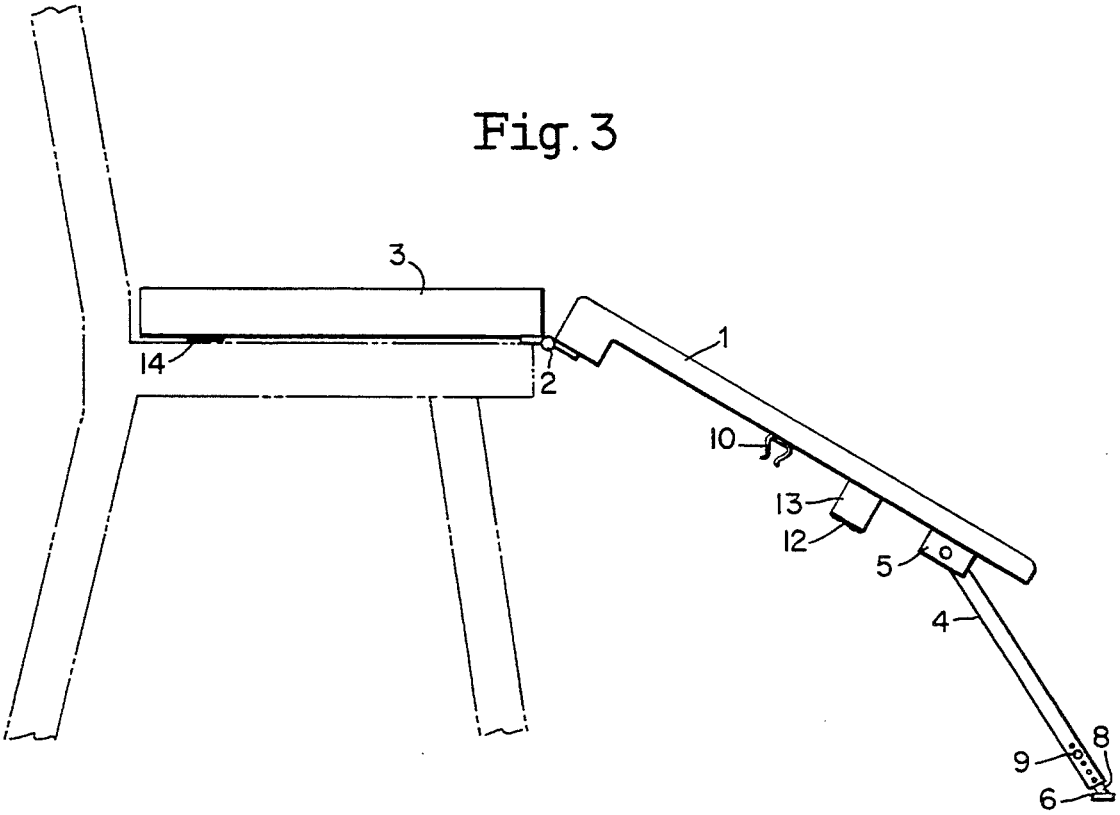
FIG. 3 is a side view showing the assembly placed on a chair in the fully open position and ready for use.
Figure 4:
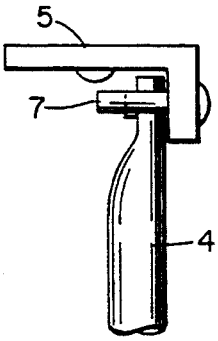
FIG. 4 is a frontal view of the leg rest supporting leg pivot.
Figure 5:
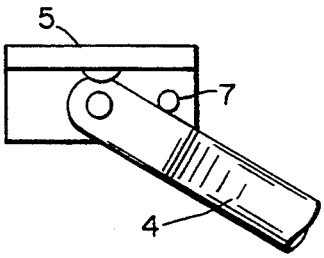
FIG. 5 is a side view of the leg rest supporting leg pivot.
Figure 6:
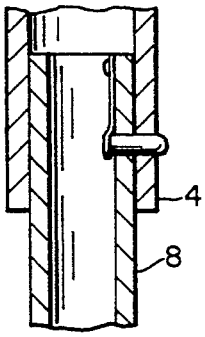
FIG. 6 is a cross-section of the spring ball and locking mechanism.
Figure 7:
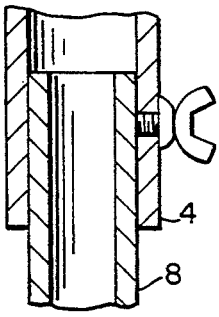
FIG. 7 is a cross-section of the adjustable threaded fastener.

Reference is made to FIG. 1 which illustrates the invention in the folded mode for storage or transport. The leg rest assembly comprises a flat, thin, rectangular platform 1 constructed of rigid or semi-rigid material. This is hingedly joined by hinge 2 to a flat, thin, rectangular seating portion 3 that is placed on a chair, sofa or bench. The upper surfaces of the leg rest 1 and the seating portion 3 are upholstered for comfort with conventional fabric, leather or flexible vinyl materials. FIG. 2 depicts the underside of the portable leg rest folded open, with leg rest supporting legs held flat against the underside of the leg rest. FIG. 3 shows the assembly ready for use on the chair. The leg rest 1 is extended forward and supported on the floor or ground by the legs 4 which are attached to the underside by the pivots 5. The placement of the pivots and length of the legs 4 is designed so that they will project forward of the leg rest and contact the floor or ground. Elastomeric feet 6 are placed at the contact point to prevent slippage. FIGS. 4 and 5 illustrate the pivots and stop pins 7 that limit the forward movement of the legs. The legs 4 (See FIGS. 1, 2 and 3) are manually adjusted by sliding the inner tubes or shafts 8 which have a series of holes up through the outer tube with a matching series of holes until the desired length and leg elevation is reached. Wing nuts 9 are used to tighten bolts that are inserted through the holes in the tubes or shafts. FIGS. 6 and 7 illustrate a spring ball and locking mechanism and an adjustable threaded mechanism that are alternate means for varying the elevation of the leg rest. The support clip 10 (See FIGS. 2 and 3) holds the leg rest support legs flat against the leg rest underside by engaging the cross bar portion 11 of the legs. A piece of hook and loop fastening material 12 in the support block on the underside of the leg rest engages complementary hook and loop fastening material 14 on the underside of the seating surface to secure the seating portion 3 to the leg rest 1 in the folded mode.

The above disclosed invention has several particular features which should preferably be employed; certain changes in the form and arrangement of parts may be made without departing from the underlying idea or principle of the invention.

I claim:

1. A portable folding leg rest comprising:

A) a thin, rectangular platform having a leg-supporting upper surface;

B) hinge means pivotally connecting said platform to a seating portion that is placed horizontally on a chair, bench or sofa:

C) a pair of leg means for supporting said platform in an inclined, elevated position above a surface on which said pair of leg means is disposed:

D) second hinge means pivotally connecting said platform and seating portion said second hinge means permitting movement of the platform through an angle of substantially 180 degrees between two useful positions, an operative, first position in which said platform extends at an angle downward from said horizontally placed seating portion, and a folded, second position in which said pair of leg means is folded back to the underside of said platform and said platform folded flat against the underside of said seating portion;

E) stop means limiting outward movement of said pair of leg means to a certain point forward of said platform;

F) extending means for varying the length of said pair of leg means, and the angle of said platform;

G) each leg of said pair of leg means including an outer tube and an inner tube telescopingly secured inside the outer tube; and H) an adjustable threaded fastening means extending from the outer tube for exerting pressure on the inner tube, thereby locking the inner tube in position relative to the outer tube.

2. The leg rest according to claim 1 in which said inner and outer tubes are concentric and include a plurality of mating holes for receiving said fastening means.

3. A portable folding leg rest comprising:

A) a thin, rectangular platform having a leg-supporting upper surface;

B) hinge means pivotally connecting said platform to a seating portion that is placed horizontally on a chair, bench or sofa;

C) a pair of leg means for supporting said platform in an inclined, elevated position above a surface on which said pair of leg means is disposed;

D) second hinge means pivotally connecting said platform and seating portion, said second hinge means permitting movement of the platform through an angle of substantially 180 degrees between two useful positions, an operative, first position in which said platform extends at an angle downward from said horizontally placed seating portion, and a folded, second position in which said pair of leg means is folded back to the underside of said platform and said platform folded flat against the underside of said seating portion;

E) stop means limiting outward movement of said pair of leg means to a certain point forward of said platform;

F) extending means for varying the length of said pair of leg means, and the angle of said platform; and G) said seating portion and said platform being provided with mating hook and loop fastening means for securing said seating portion to said platform in said folded, second position.

4. A portable folding leg rest comprising:

A) a thin, rectangular platform having a leg-supporting upper surface;

B) hinge means pivotally connecting said platform to a seating portion that is placed horizontally on a chair, bench or sofa;

C) a pair of leg means for supporting said platform in an inclined, elevated position above a surface on which said pair of leg means is disposed;

D) second hinge means pivotally connecting said platform and seating portion, said second hinge means permitting movement of the platform through an angle of substantially 180 degrees between two useful positions, an operative, first position in which said platform extends at an angle downward from said horizontally placed seating portion, and a folded, second position in which said pair of leg means is folded back to the underside of said platform and said platform folded flat against the underside of said seating portion;

E) stop means limiting outward movement of said pair of leg means to a certain point forward of said platform;

F) extending means for varying the length of said pair of leg means, and the angle of said platform; and G) a snap clip provided on a lower surface of the platform for engaging a crossbar of the pair of leg means.

* * * * *